US005471360A

United States Patent [19]

Ishikawa et al.

[11] Patent Number: 5,471,360

[45] Date of Patent: Nov. 28, 1995

[54] DC ELECTROMAGNET APPARATUS

[75] Inventors: Minoru Ishikawa; Kimitada Ishikawa, both of Kawasaki, Japan

[73] Assignee: Fuji Electric Co., Ltd., Kawasaki, Japan

[21] Appl. No.: 166,031

[22] Filed: Dec. 14, 1993

[30] Foreign Application Priority Data

Dec. 15, 1992 [JP] Japan ..... 4-333340

[51] Int. Cl.[6] ..... H01H 47/02

[52] U.S. Cl. ..... 361/154

[58] Field of Search ..... 361/152–156

[56] References Cited

U.S. PATENT DOCUMENTS 4,511,945 4/1985 Nielsen ..... 361/154
4,978,865 12/1990 Hartmann et al. ..... 361/152 X
5,214,561 5/1993 Morita ..... 361/187

FOREIGN PATENT DOCUMENTS 59-168607 9/1984 Japan .
61-187304 8/1986 Japan .
61-182204 8/1986 Japan .
61-256608 11/1986 Japan .

*Primary Examiner*—A. D. Pellinen
*Assistant Examiner*—Fritz M. Fleming
*Attorney, Agent, or Firm*—Spencer, Frank & Schneider

[57] ABSTRACT

A DC electromagnet apparatus that can prevent an excessive making coil current caused by changes in a power supply voltage. The electromagnet has an operation coil, a switching device, and a current detecting resistor connected in series. A one-shot pulse generating circuit produces a one-shot pulse having a pulse width corresponding to the duration of the making coil current flowing through the operation coil to close the electromagnet. A Miller circuit generates, based on the one-shot pulse, a trapezoidal pulse having a predetermined rising rate, a predetermined peak value, and a pulse width substantially equal to that of the one-shot pulse. A comparator produces an ON control signal that controls the switching device in such a manner that the making coil current becomes proportional to the trapezoidal pulse.

5 Claims, 9 Drawing Sheets

FIG. 5(a) COIL CURRENT

FIG. 5(b) OUTPUT OF CONSTANT CURRENT CIRCUIT (PRIOR ART)

(PRIOR ART)

FIG. 8(a) v
Vref1
FIG. 8(b) Sd1
FIG. 8(c) Sp
ONE-SHOT PULSE
TC
FIG. 8(d) Sd2
FIG. 8(e) Tp
E2
dE1/dt
dE3/dt
FIG. 8(f) Sd3
FIG. 8(g) Sd4
FIG. 8(h) i
HOLDING CURRENT
MAKING CURRENT
t0
t1
t2
t3
TIME

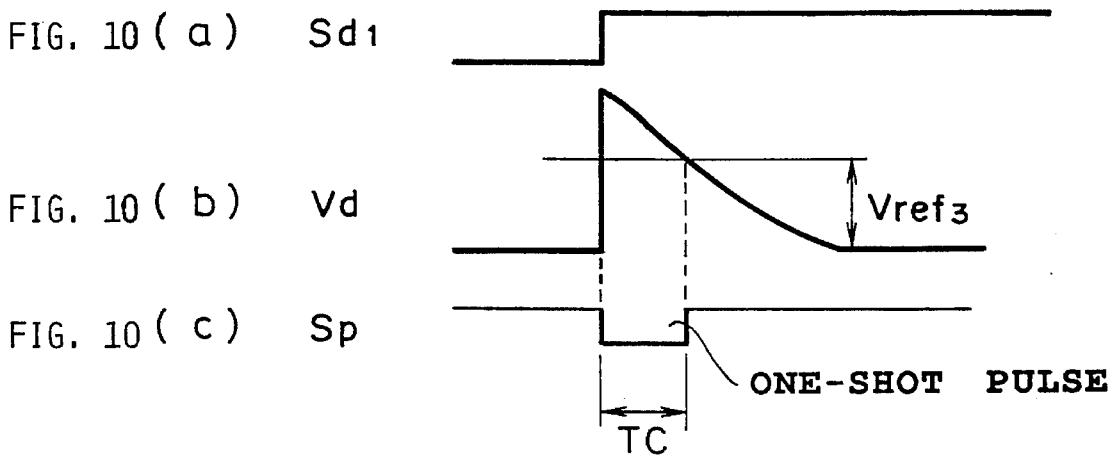
FIG. 10 ( a ) Sd1
FIG. 10 ( b ) Vd
Vref3
FIG. 10 ( c ) Sp
ONE-SHOT PULSE
TC

DC ELECTROMAGNET APPARATUS

BACKGROUND OF THE INVENTION

1. Field of the Invention

The present invention relates to a DC electromagnet apparatus used for driving an electromagnetic contactor or the like.

2. Description of Related Art

Generally, an electromagnet has a stator core on which an operation coil is wound, and a movable core faced with the stator core via a gap. When the stator core is energized, the movable core is attracted to the stator core travels the length of the gap. During this movement, the movable core moves against the force caused by a load to be driven and a spring. In this case, a larger attractive force is required at an initial stage of closing the electromagnet, and a smaller attractive force is enough to maintain the movable core at the closing position after completing the attraction.

As a conventional electromagnet apparatus implemented in view of such characteristics, an electromagnet apparatus is known using a driving circuit as described in Japanese Patent Application Laying-Open No. 168607/1984.

FIG. 1 shows the conventional driving circuit for an electromagnet. In this figure, an operation coil 1 of the electromagnet is connected in series with a switching device 5*d* such as a transistor between the output terminals P and N of a DC power supply. The switching device 5*d* is controlled by a control power supply circuit 6, a voltage detecting circuit 7, a timer circuit 8 and an oscillating circuit 9. The outputs of the voltage detecting circuit 7 and the timer circuit 8, and the output of the oscillating circuit 9 are supplied to the switching device 5*d* through an OR gate 10 and a resistor 11. In addition, a manual switch 4 is provided for switching the DC power supply.

The operation of the circuit of FIG. 1 will be explained referring to a waveform diagram of FIG. 2. When the manual switch 4 is turned on, and the power supply voltage across the terminals P and N exceeds a predetermined value, the voltage detecting circuit 7 produces an output signal, and supplies it to the switching device 5*d* through the OR gate 10 and the resistor 11. Thus, the switching device 5*d* is turned on at time t1 of FIG. 2, thereby supplying the operation coil 1 with a large current required to operate the electromagnet. The current causes the electromagnet to close at time $t_2$ of FIG. 2. At this point, the switching device 5*d* is still conductive, and hence a large current flows through the operation coil 1. The output of the voltage detecting circuit 7 starts the timer circuit 8. The timer circuit 8 outputs a signal after a predetermined time period, and stops the signal from the voltage detecting circuit 7, thereby turning off the switching device 5*d* at time $t_3$. At the same time, the output of the timer circuit 8 is supplied to the oscillating circuit 9. The oscillating circuit starts to operate, and outputs a pulse train. The pulse train is applied to the switching device 5*d* through the OR gate 10 and the resistor 11, and the switching device 5*d* turns on and off alternately. Accordingly, the operation coil 1 is supplied with a pulsatile voltage. In this case, the actual current flowing through the operation coil 1 is smoothed by a free-wheeling diode 14. Thus, the electromagnet is maintained at a making (closing) condition with a small current by selecting an appropriate ON/OFF ratio.

The conventional DC electromagnet apparatus, however, presents a problem, which will be explained with reference to FIG. 3. In the circuit shown in FIG. 1, since the power supply voltage is directly applied to the operation coil 1, the attractive force of the electromagnet will change greatly depending on the power supply voltage. Currently, the range of a working voltage for driving an electromagnetic contactor is specified at 85–110% of its rated voltage. Therefore, the electromagnetic portion of the contactor must be designed such that it produces, at a making operation, a sufficient attractive force even if a voltage of 85% of the rated voltage is used. The attractive force f of an electromagnet, however, is proportional to the square of the applied voltage v as show in FIG. 3. As a result, an increasing voltage will produce an unduly large attractive force. This large attractive force will produce a strong impact on the core of the electromagnet and other portions thereof, and hence, will shorten a lifetime of the mechanism of the contactor. In addition, the large attractive force will cause chattering of the main contacts, and this will reduce the lifetime of the contacts.

FIG. 3 is a graph illustrating the attractive force of a common electromagnet. The abscissa represents an applied voltage v and the ordinate represents the attractive force f of the electromagnet, and $f_0$ denotes the attractive force required to close the electromagnet. It is seen from this graph that the attractive force f sharply increases from the attractive force f0 as the applied voltage v increases.

To overcome this problem, another DC electromagnet apparatus is proposed by Japanese Patent Application Laying-Open No. 187304/1986. FIG. 4 shows the circuit, and FIGS. 5(*a*) and 5(*b*) show the relationship between the changes in the coil current flowing through a coil 1 of FIG. 4, and the output of a constant current circuit 16. More specifically, the electromagnet driving circuit of FIG. 4 includes a control power supply circuit 6, a voltage detecting circuit 7, a timer circuit 15, a constant current circuit 16 and an AND gate 17. The control power supply circuit supplies power to the voltage detecting circuit 7, timer circuit 15 and constant current circuit 16. A first output of the voltage detecting circuit 7 is connected to the input of the timer circuit 15 and a second output to a first input of the AND gate 17. The output of the timer circuit 15 is connected to a first input A of the constant current circuit 16, and the output of the constant current circuit 16 is connected to a second input of the AND gate.

The output of the AND gate 17 is connected through a resistor 11 to the base of a transistor 5*b* having its collector connected through a resistor 13 to the base of a transistor 5*a*. The transistors 5*a*, 5*b* and the resistors 11, 13 comprise a switching circuit 5.

The collector of the transistor 5*a* is connected to the control power supply circuit 6, and its emitter to an operation coil 1 of an electromagnet in series with a current detecting circuit 12 comprising a resistor 12a. The junction of the operation coil 1 and the resistor 12a is coupled to an input B of the constant current circuit 16.

The operation of the circuit is as follows: First, coil current i flowing through the operation coil 1 produces a voltage across resistor 12*a* which is coupled to the input B of constant current circuit 16. If the coil current i is smaller than a set level $I_1$ of the constant current circuit 16, the constant current circuit 16 produces an output so that a voltage is supplied via AND gate 17 and switching circuit 5 to the operation coil 1 to increase the coil current i. In contrast, if the coil current i exceeds the set level $I_1$, the constant current circuit 16 stops the output so that the coil current i is reduced. If the coil current i become less than the set level $I_1$ again, the constant current circuit 16 restarts the output in order to increase the coil current i. This operation is repeated to maintain the coil current i at a constant value. Furthermore, the holding current of the electromagnet is produced by performing a similar control using the set level $I_2$ lower than the set level $I_1$ so that the coil current i required to hold the electromagnet is maintained.

This conventional DC electromagnet apparatus presents the following problem: FIGS. 6(*a*), 6(*b*) and 6(*c*) are a waveform diagrams illustrating the operation of the electromagnet apparatus at a low power supply voltage v1 and at a high power supply voltage $v_2$. When the power supply voltage v is outputted at time $t_0$ as shown in FIG. 6(*a*), the coil current i will start to increase. In this case, the rising rate of the coil current i is small as indicated by the solid line $i_1$ when the power supply voltage v is at the low voltage $v_2$, whereas it is large as indicated by the broken line $i_2$ when the power supply voltage v is at the high voltage $v_2$. As a result, even if the coil current i is limited to the set value $I_1$ as shown in FIG. 6(*b*), the electromagnet will make (close) at time $t_1$ after a rather long operating time $TM_1$ at the low power supply voltage $v_1$, and at time $t_2$ after a short operating time $TM_2$ at the high power supply voltage $v_2$. In FIG. 6(*b*), the dip points of the coil current i correspond to the making (closing) points of the electromagnet. The dip points are induced by an increase in the inductance of the operation coil 1 when the electromagnet is closed. This circuit must provide the operation coil 1 with a coil current throughout the time period TC (until time $t_3$) that exceeds the longer operating time $TM_1$ associated with the lower power supply voltage $v_1$, even if the higher power supply voltage $v_2$ is supplied, and hence the electromagnet completes its making in the shorter operating time $TM_2$. As a result, when the power supply voltage v is $v_2$ , an excessive coil current flows, which makes it difficult to reduce the impact at the making of the electromagnet.

SUMMARY OF THE INVENTION

It is therefore an object of the present invention to provide a DC electromagnet apparatus that prevents excessive coil current even when the power supply voltage is high.

According to the present invention, there is provided a DC electromagnet apparatus comprising:

a stator core on which an operation coil is wound;

a movable core faced with the stator core via a gap;

a switching device connected in series with the operation coil;

a detecting resistor, connected in series with the operation coil and the switching device, for detecting a coil current flowing through the operation coil;

a voltage detecting circuit detecting a power supply voltage, and generating a detection signal when the power supply voltage exceeds a predetermined reference voltage;

a one-shot pulse generating circuit for generating a one-shot pulse whose pulse width corresponds to a duration of a making time coil current flowing through the operation coil;

a Miller circuit receiving the one-shot pulse outputted from the one-shot pulse generating circuit, and producing a trapezoidal pulse having a predetermined rising rate, a predetermined peak value, and a pulse width substantially equal to that of the one-shot pulse;

a voltage divider dividing the detection signal outputted from the voltage detecting circuit at a predetermined ratio;

an integrator integrating a voltage across the detecting resistor for detecting the coil current flowing through the operation coil; and a comparator whose first input terminal is supplied with a higher voltage of the output of the voltage divider and the peak value of the trapezoidal pulse outputted from the Miller circuit, and whose second input terminal is supplied with the output of the integrator, the comparator supplying an ON control signal to the control terminal of the switching device when the voltage applied to the first input terminal is higher than that applied to the second input terminal.

The DC electromagnet apparatus may further comprise a constant voltage circuit producing a constant voltage, and the voltage detecting circuit may comprise a first voltage divider dividing the power supply voltage, a second voltage divider dividing the constant voltage to produce a first reference voltage, and an operational amplifier whose noninverting input terminal is supplied with the divided voltage produced by the first voltage divider, and whose inverting input terminal is supplied with the first reference voltage, the operational amplifier outputting the detection signal when the voltage supplied to the noninverting input terminal is higher than the first reference voltage.

The DC electromagnet apparatus may further comprise a constant voltage circuit producing a constant voltage, and the one-shot pulse generating circuit may comprise:

a charging circuit including a capacitor to which the detection signal outputted from the voltage detection circuit is supplied, and a resistor connected in series with the capacitor;

a third voltage divider dividing the constant voltage to generate a third reference value;

an operational amplifier whose noninverting input terminal is supplied with the third reference voltage, and whose inverting input terminal is supplied with a voltage across the resistor of the charging circuit, the operational amplifier outputting the one-shot pulse when the voltage supplied to the inverting input terminal is higher than the third reference voltage.

The Miller circuit may comprise:

an operational amplifier whose noninverting input terminal is supplied with a second reference voltage, and whose inverting input terminal is supplied with the one-shot pulse outputted from the one-shot pulse generating circuit, the operational amplifier producing the output of the Miller circuit when the one-shot pulse is lower than the second reference voltage; and a charge-discharge circuit connected between the output terminal of the operational amplifier and the output terminal of the one-shot pulse generating circuit.

The rising rate of the trapezoidal pulse outputted from the Miller circuit may be set lower than the rising rate of the voltage across the detecting resistor detecting the coil current flowing through the operation coil when the power supply voltage changes in a working voltage range.

In the DC electromagnet apparatus in accordance with the present invention, the Miller circuit outputs, in response to the one-shot pulse produced from the one-shot pulse generating circuit, a trapezoidal pulse that has a predetermined rising rate, a predetermined peak value, and a pulse width substantially equal to the pulse width of the one-shot pulse, which corresponds to the duration of the making coil current. Since the peak value of the trapezoidal pulse is set higher than the divided voltage of the detection signal of the voltage detecting circuit, the trapezoidal pulse is supplied to the first input terminal of the comparator as soon as the trapezoidal pulse is outputted. At the same time, a voltage proportional to the coil current of the operation coil, which will become the making coil current (the current necessary to close the gap of the electromagnet), is supplied to the second input terminal of the comparator through the detecting resistor detecting the coil current. Thus, the switching device controls, during the making of the electromagnet, the making coil current in such a manner that its rising rate substantially equals that of the trapezoidal pulse, and the current value and duration do not exceeds those determined by the trapezoidal pulse.

In addition, by setting the rising rate of the trapezoidal pulse lower than the rising rate of the making coil current of the operation coil (more precisely, the rising rate of the voltage across the detecting resistor detecting the coil current, which is induced by the making coil current) that will occur in the range of changes in a given working power supply voltage, the rising rate of the making coil current is controlled at a constant value independently of the changes in the working power supply voltage. Relating the rising rate, the peak value, and the pulse width of the trapezoidal pulse to the rising rate, the current value, and the duration of the making coil current, respectively, makes it possible to keep the making coil current constant independently of the changes in the working power supply voltage, and hence, to prevent excessive coil current. This also reduces the impact at closing the electromagnet. Furthermore, since the value and duration of the making coil current are determined regardless of the power supply voltage, a wide working voltage range such as from 100 V to 200 V can be achieved.

The above and other objects, effects, features and advantages of the present invention will become more apparent from the following description of the embodiments thereof taken in conjunction with the accompanying drawings.

BRIEF DESCRIPTION OF THE DRAWINGS

FIGS. 10(*a*)–10(*c*) are diagrams illustrating waveforms of the one-shot pulse generating circuit shown in FIG. 9.

DETAILED DESCRIPTION OF PREFERRED EMBODIMENTS

The invention will now be described with reference to the accompanying drawings.

Figure 1:
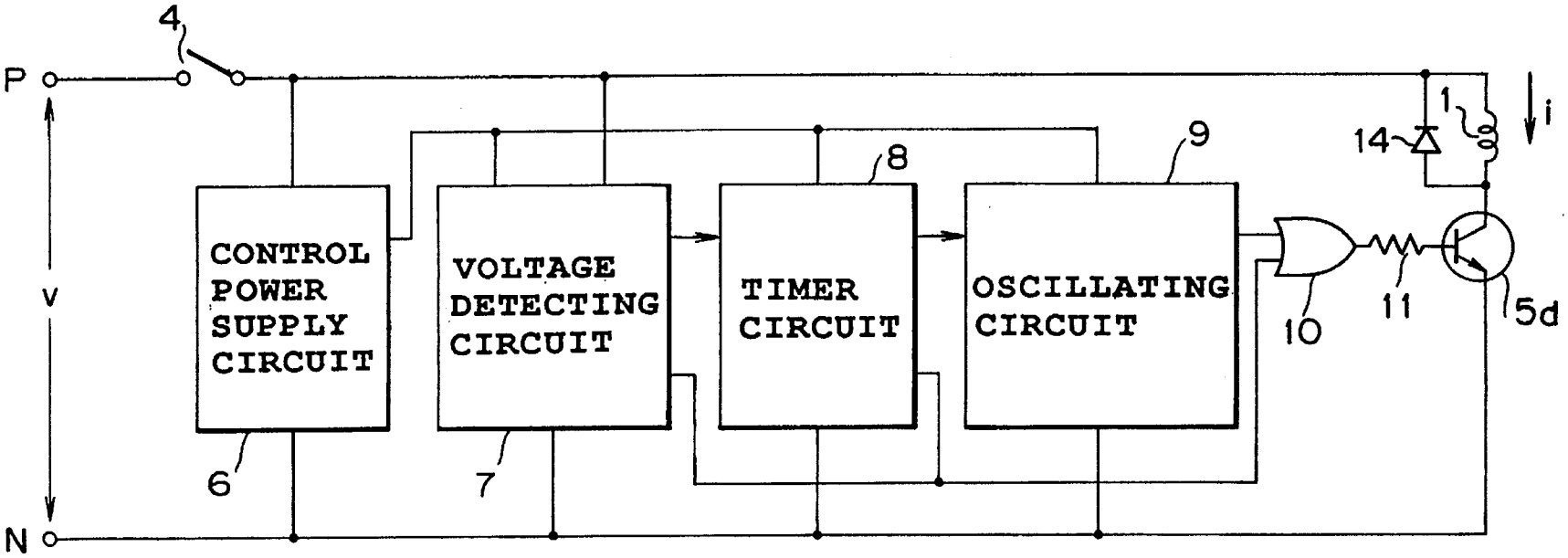
FIG. 1 (PRIOR ART)
FIG. 1 is a circuit diagram showing a conventional electromagnet apparatus.
Figure 2:
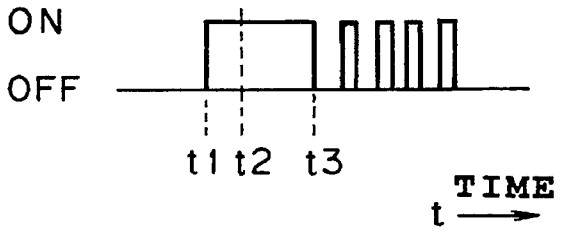
FIG. 2 (PRIOR ART)
FIG. 2 is a diagram illustrating a waveform of the coil current of the electromagnet of FIG. 1.
Figure 3:
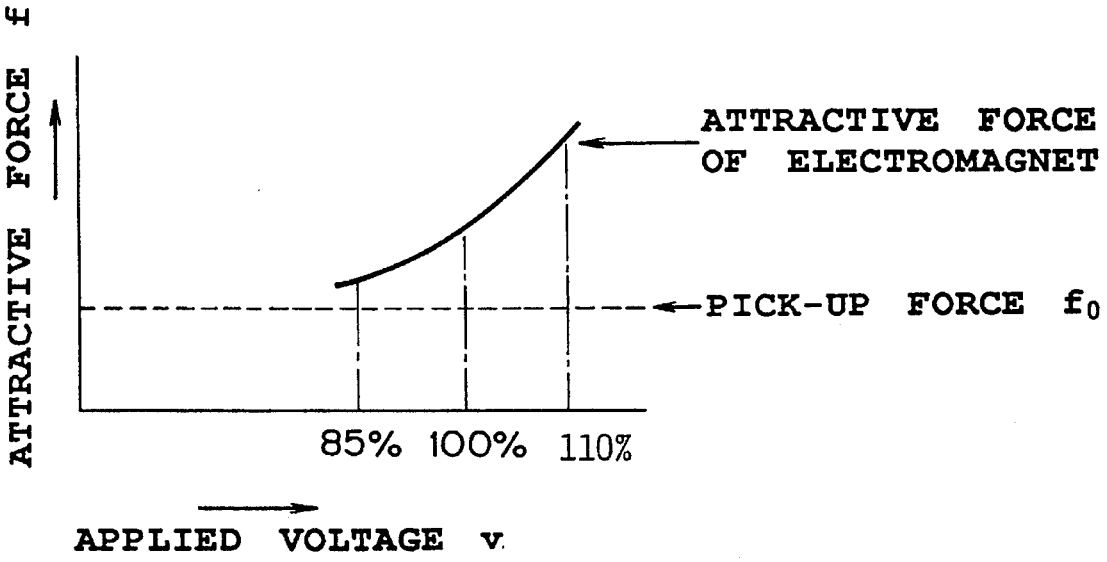
FIG. 3 (PRIOR ART)
FIG. 3 is a graph illustrating the relationship between an applied voltage and the attractive force of a common electromagnet.
Figure 4:
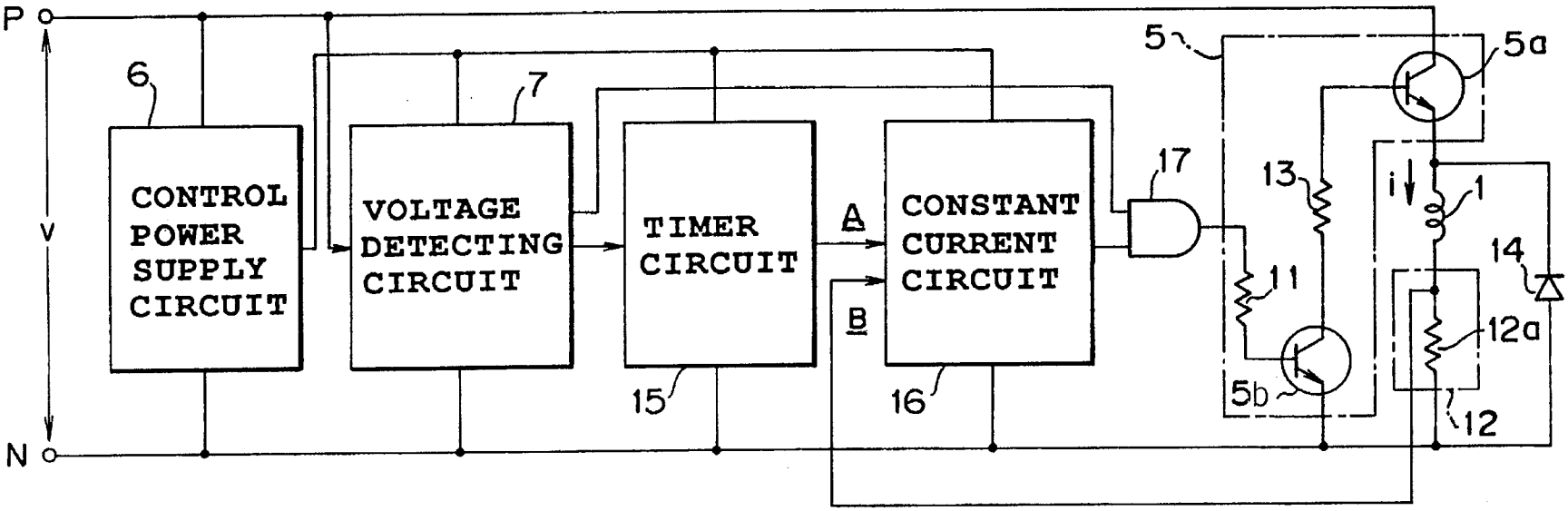
FIG. 4 (PRIOR ART)
FIG. 4 is a circuit diagram showing another conventional electromagnet apparatus.
Figure 5:
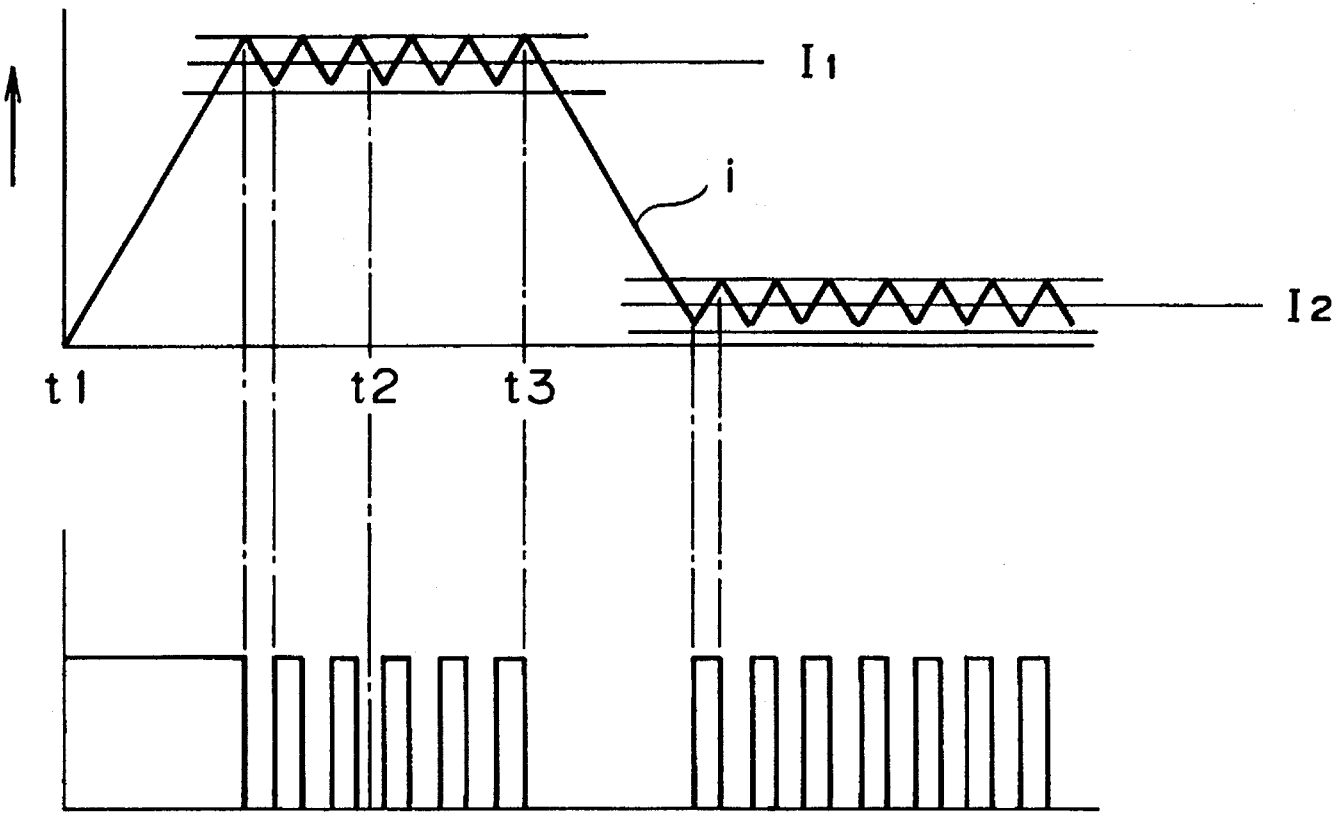
FIGS. 5(*a*) and 5(*b*) and FIGS. 6(*a*), 6(*b*) and 6(*c*) are diagrams illustrating waveforms of the conventional electromagnet apparatus as shown in FIG. 4.
Figure 6:
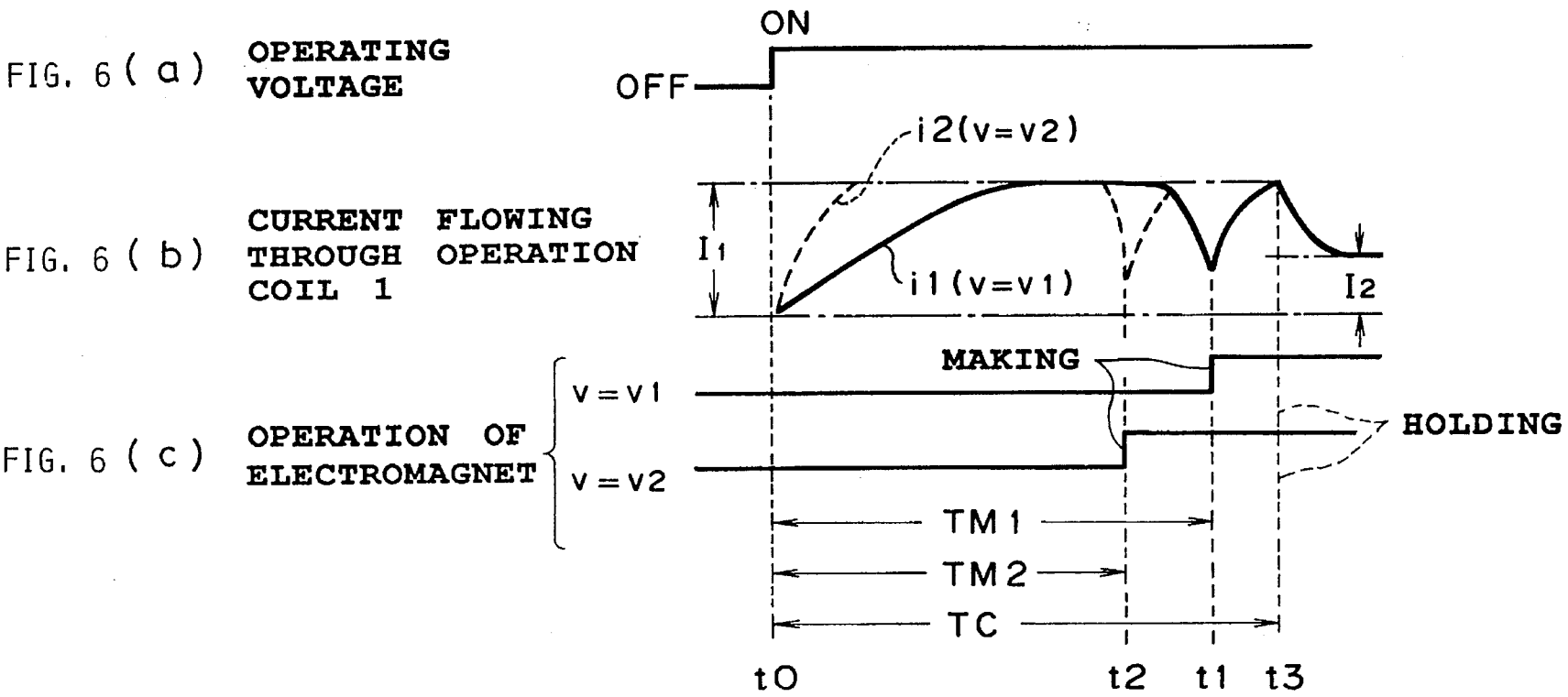
Figure 7:
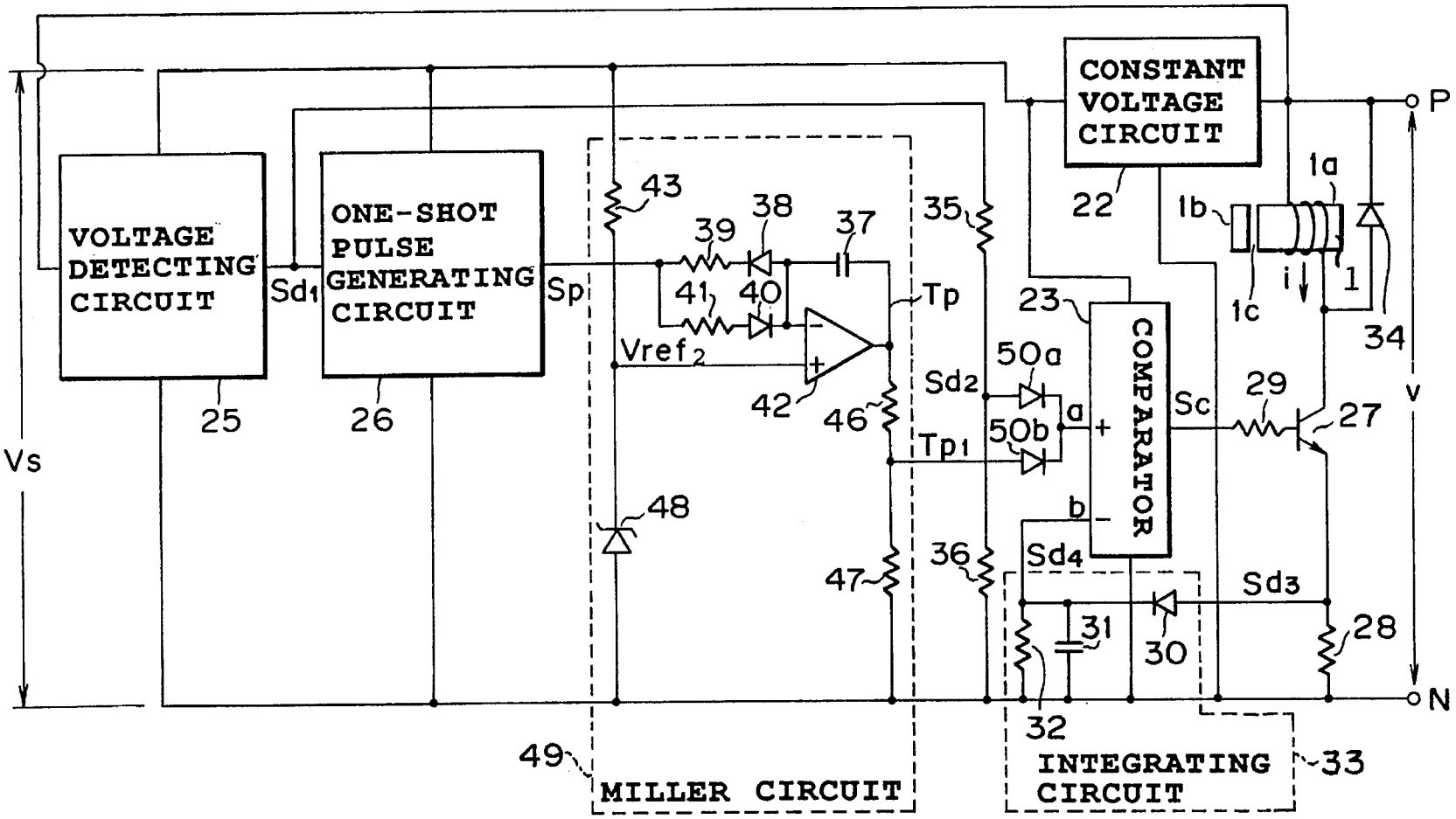
FIG. 7 is a circuit diagram showing an embodiment of a DC electromagnet apparatus in accordance with the present invention.

FIG. 7 is a circuit diagram showing an embodiment of a DC electromagnet apparatus in accordance with the present invention. In FIG. 7, the DC electromagnet apparatus comprises a stator core 1*a*, on which an operation coil 1 is wound, and a movable core 1*b* facing the stator core 1*a* via a working gap 1*c*. The operation coil 1 is connected in series with a switching device 27 and a current detecting resistor 28, and the serial circuit is provided with a power supply voltage v. A voltage detecting circuit 25 detects the power supply voltage v, and outputs a detection signal $S_{d1}$ if the voltage v is greater than a predetermined reference value $V_{ref1}$ shown in FIG. 8(*a*). The detection signal $S_{d1}$ starts a one-shot pulse generating circuit 26, which generates a one-shot pulse Sp having a width corresponding to the duration of the making coil current of the operation coil 1.

The one-shot pulse Sp is supplied to a Miller circuit (Miller integrator) 49, which generates a trapezoidal pulse Tp having a predetermined rising rate, a predetermined peak value, and a pulse width substantially equal to the pulse width of the one-shot pulse Sp. The detection signal $S_{d1}$ is divided by resistors 35 and 36, and the divided detection signal $S_{d2}$ is applied to a diode 50*a*. On the other hand, the trapezoidal pulse Tp is divided by resistors 46 and 47, and the divided trapezoidal pulse $T_{p1}$ is applied to a diode 50*b*. The diodes 50*a* and 50*b* are connected to a noninverting input a of a comparator 23, and hence, the higher voltage of the two voltages $S_{d2}$ and $T_{p1}$ is applied to the noninverting input a.

An integrating circuit 33 includes a diode 30, a capacitor 31 and a resistor 32, and integrates a voltage $S_{d3}$ across the current detecting resistor 28. The output $S_{d4}$ of the integrating circuit 33 is fed to an inverting input b of the comparator 23. The comparator 23 supplies the control terminal of the switching device 27 with an ON control signal Sc through a gate resistor 29 when the input to the noninverting input a of the comparator 23 is higher than the input to the inverting input b. In FIG. 7, the reference characters P and N designate power supply terminals, the reference numeral 34 designates a freewheeling diode connected in antiparallel with the operation coil 1, and the reference numeral 22 denotes a constant voltage circuit producing a control voltage of a constant voltage Vs based on the power supply voltage v inputted thereto.

The Miller circuit 49 includes a reference voltage circuit which consists of a resistor 43 and a Zener diode 48 connected in series to the output of the constant voltage circuit 22, and produces a reference voltage $V_{ref2}$ across the Zener diode 48. The reference voltage $V_{ref2}$ is supplied to the noninverting input of an operational amplifier 42. The inverting input of the operational amplifier 42 is connected to the output of the one-shot pulse generating circuit 26 through a resistor 41 and a diode 40. The output of the operational amplifier 42, that is, the trapezoidal pulse Tp is supplied to the dividing resistors 46 and 47. A capacitor 37 is connected between the inverting input and the output of the operational amplifier 42. In addition, a serial circuit of a diode 38 and a resistor 39 is connected in parallel with the serial circuit of the diode 40 and the resistor 41 in such fashion that the diodes 38 and 40 are connected in opposite directions.

Figure 8:
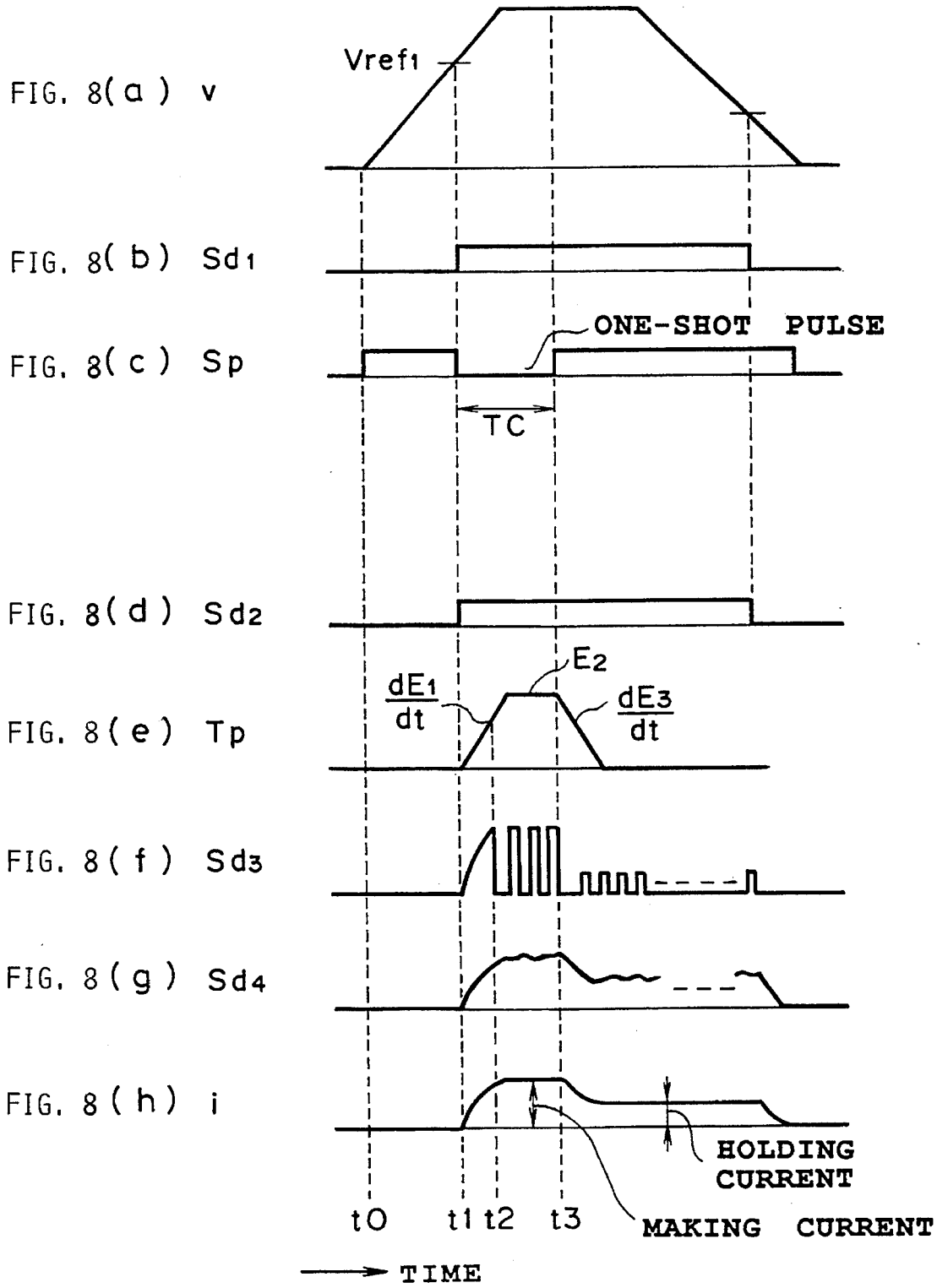
FIGS. 8(*a*)–8(*h*)are diagrams illustrating waveforms of the DC electromagnet apparatus shown in FIG. 7.

The operation of the electromagnet apparatus will now be described with reference to the waveform diagram of FIG. 8(*a*)–8(*c*) in addition to FIG. 7. In FIG. 8(*a*), shows the power supply voltage v, which is applied to the power supply terminals P and N, and gradually increases with time. Such a waveform is obtained when an induction motor is started, for example. More specifically, the power supply is substantially shortcircuited by the induction motor immediately after a switch is turned on, and hence, the power supply voltage v will drop by a large amount. Subsequently, the power supply voltage v will gradually recover to the normal voltage with an increase in the number of revolutions of the induction motor. This is usually a very bad condition for the electromagnet apparatus, and hence, it is liable to malfunction. When the power supply voltage v exceeds the predetermined reference value $V_{ref1}$ at time $t_1$, the voltage detecting circuit 25 outputs the detection signal $S_{d1}$ as shown in FIG. 8(*b*). The detection signal $S_{d1}$ is inputted to the one-shot pulse generating circuit 26, which outputs the low level one-shot pulse Sp whose pulse width TC corresponds to the duration of the making coil current of the operation coil 1, as shown in FIG. 8(*c*).

The noninverting input of the operational amplifier 42 of the Miller circuit 49 is provided with the reference voltage $V_{ref2}$ produced across the Zener diode 48 of the reference voltage circuit which consists of the resistor 43 and the Zener diode 48. On the other hand, the inverting input of the operational amplifier 42 is provided with the output signal of the one-shot pulse generating circuit 26 through the resistor 41 and the diode 40. Since the output of the one-shot pulse generating circuit 26 is higher than the reference voltage $V_{ref2}$ before time $t_1$, the output of the operational amplifier 42 is a low level. In this state, when the high level output signal of the one-shot pulse generating circuit 26 changes to the low level one-shot pulse Sp of pulse width TC at time $t_1$, the output of the operational amplifier 42 changes to the high level. Accordingly, a current flows from the output of the operational amplifier 42 to the one-shot pulse generating circuit 26 through the capacitor 37, the diode 38 and the resistor 39, thereby charging the capacitor 37. The time constant of the charge is chiefly determined by the capacitance of the capacitor 37 and the resistance of the resistor 39. Thus, the operational amplifier 42 produces the voltage Tp whose rising rate is $dE_1/dt$. When the charge of the capacitor 37 has been completed, the output of the operational amplifier 42 is settled at a constant voltage $E_2$. When the one-shot pulse is eliminated at time $t_3$ after time period TC has passed from time $t_1$, the output Sp of the one-shot pulse generating circuit 26 returns to the high level. Accordingly, a current flows from the one-shot pulse generating circuit 26 to the output of the operational amplifier 42 through the resistor 41, the diode 40 and the capacitor 37, thereby discharging the capacitor 37. The time constant of the discharge is determined by the capacitance of the capacitor 37 and the resistance of the resistor 41. Thus, the output of the operational amplifier 42 falls toward zero at a falling rate of $dE_3/dt$. As a result, the Miller circuit 49 outputs a trapezoidal pulse Tp having the rising rate of $d_1m/dt$, the peak value of $E_2$, and the falling rate of $dE_3/dt$, as shown in FIG. 8(*e*). The trapezoidal pulse is divided by the resistors 46 and 47, and the divided pulse is applied to the non-inverting input a of the comparator 23.

Here, the trapezoidal pulse Tp outputted from the Miller circuit 49 is set at a high voltage so that it can be used as a making pulse, and the divided voltage $S_{d2}$ (see, FIG. 8(*d*) of the detection signal $S_{d1}$ from the voltage detecting circuit 25 is set at a low voltage so that it is used as a holding pulse. When the high voltage trapezoidal pulse Tp is outputted from the Miller circuit 49 at time $t_1$, it increases at a rate of $dE_1/dt$, and immediately exceeds the divided voltage $S_{d2}$. Therefore, the divided voltage $T_{p1}$ of the trapezoidal pulse Tp is inputted to the noninverting input a of the comparator 23. Although the inverting input b of the comparator 23 is provided with the output $S_{d4}$ Of the integrating circuit 33, the voltage $T_{p1}$ is higher than the voltage $S_{d4}$ from time $t_1$ to time $t_2$. Accordingly, the high level 0N control signal Sc is supplied from the comparator 23 to the control terminal of the switching device 27, thereby turning on the switching device 27. Thus, the coil current i flows through the operation coil 1, which induces the voltage $S_{d3}$ across the current detecting resistor 28 as shown in FIG. 8(*f*). This voltage is smoothed through the integrating circuit 33, and the smoothed voltage $S_{d4}$ is fed to the inverting terminal b of the comparator 23 as shown in FIG. 8(*g*).

The comparator 23 outputs the ON control signal Sc when the voltage inputted to the noninverting input a is greater than that inputted to the inverting input b as mentioned above, so that the switching device 27 is turned on, and the coil current i flows through the operation coil 1. When the voltage $S_{d4}$ inputted to the inverting input b exceeds the voltage $T_{p1}$ inputted to the noninverting input a owing to the increase in the coil current i, the output of the comparator 23 falls to the low level, thereby turning off the switching device 27. During time $t_{2-t3}$, the output of the comparator 23, and hence, the voltage across the current detecting resistor 28, alternates between the low and high levels to control the switching device 27, as shown in FIG. 8(*f*). Thus, the making coil current i is controlled such that it does not exceed a current value corresponding to the trapezoidal pulse Tp. The actual coil current i flowing through the operation coil 1 is shown in FIG. 8(*h*). This current is obtained by smoothing the current flowing through the switching device 27 by the freewheeling diode 34.

At time t3 at which the one-shot pulse Sp terminates as shown in FIG. 8(*c*), the trapezoidal pulse Tp begins to fall, and is eliminated as shown in FIG. 8(*e*). As a result, the divided voltage $S_{d2}$ is applied to the noninverting input a of the comparator 23. Since the voltage $S_{d2}$ is set lower than the trapezoidal pulse $T_{p1}$, a low coil current (a holding coil current) i flows through the operation coil 1 as shown in FIGS. 8(*f*), 8(*g*) and 8(*h*).

By setting the rising rate $dE_1/dt$ of the trapezoidal pulse Tp lower than the rising rate of the making coil current i occurring in the range of changes in a given working power supply voltage (or more strictly, the rising rate of the voltage $S_{d3}$ across the current detecting resistor 28 induced by the making coil current i), the rising rate of the making coil current i is controlled at a constant value independently of changes in the power supply voltage. Furthermore, by setting the peak value $E_2$ of the trapezoidal pulse Tp at a value corresponding to the making coil current i (more strictly, corresponding to the voltage $S_{d3}$) that would not cause mechanical impact at the closing of the DC electromagnet, an appropriate making coil current is produced. Here, the duration of the making coil current is determined by the width of the trapezoidal pulse Tp, that is, by the width of the one-shot pulse Sp. This prevents the excessive making coil current, and reduces the impact at making the electromagnet. It is preferable that the falling rate $dE_3/dt$ of the trapezoidal pulse Tp be set as high as possible so that the coil current is switched to the holding current as promptly as possible.

Furthermore, according to the DC electromagnet apparatus, a wide range of working power supply voltage, from 100 V to 200 V, for example, can be achieved because the making coil current is determined by the trapezoidal pulse Tp outputted from the Miller circuit 49.

Figure 9:
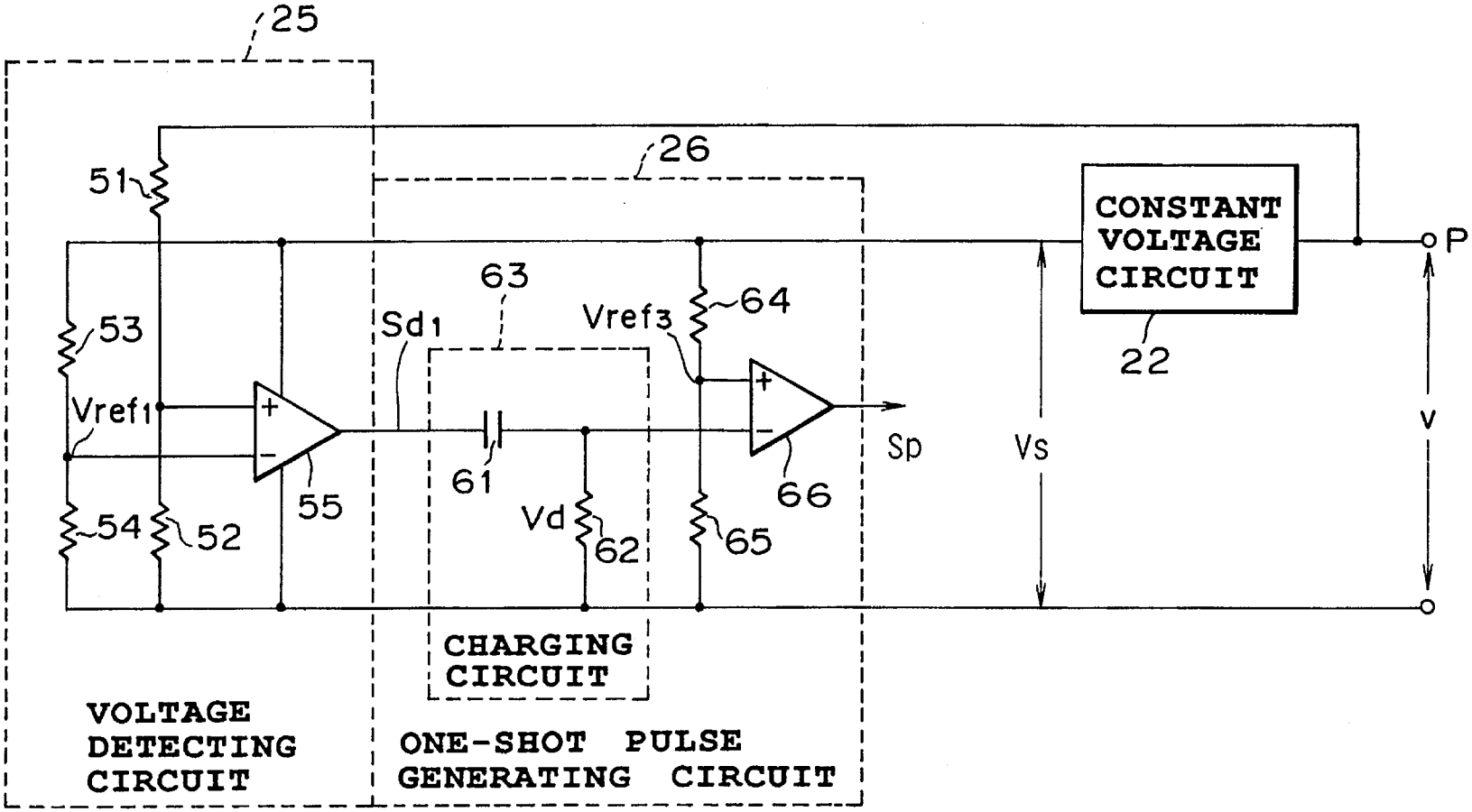
FIG. 9 is a circuit diagram of a voltage detecting circuit and a one-shot pulse generating circuit of the DC electromagnet apparatus shown in FIG. 7.

FIG. 9 shows an example of the voltage detecting circuit 25 and the one-shot pulse generating circuit 26. In FIG. 9, the voltage detecting circuit 25 comprises an operational amplifier 55, dividing resistors 51 and 52 which divide the power supply voltage v, and supply the divided voltage to the noninverting input of the operational amplifier 55, dividing resistors 53 and 54 which divide the constant voltage $V_s$ from the constant voltage circuit 22, and supply the divided voltage to the inverting input of the operational amplifier 55 as the reference voltage $V_{ref1}$. The operational amplifier 55 outputs the detection signal $S_{d1}$ when the divided voltage of v is greater than the reference voltage $V_{ref1}$. In other words, the voltage detecting circuit 25 outputs the detection signal $S_{d1}$ when the power supply voltage v exceeds the reference voltage $V_{ref1}$ determined by the constant voltage $V_s$ and the ratio of resistors 51 and 52.

In FIG. 9, the one-shot pulse generating circuit comprises a charging circuit 63, dividing resistors 64 and 65, and an operational amplifier 66. The charging circuit 63 includes a capacitor 61 and a resistor 62, which are connected in series. The capacitor 61 receives the detection signal $S_{d1}$ from the voltage detecting circuit 25, and a voltage Vd across the resistor 62 is supplied to the inverting input of the operational amplifier 66. The dividing resistors 64 and 65 divide the constant voltage $V_s$ supplied from the constant voltage circuit 22, and supply the divided voltage $V_{ref3}$ to the noninverting input of the operational amplifier 66.

FIGS. 10(*a*)–10(*d*) illustrate waveforms for explaining the operation of the circuit as shown in FIG. 9. The capacitor 61 of the charging circuit 63 is charged by the detection signal $S_{d1}$ from the voltage detecting circuit 25 (see, FIG. 10(*a*), and a current flows through the resistor 62. The current falls from its initial value at a time constant determined by the capacitor 61 and the resistor 62, and induces the voltage Vd across the resistor 62 as shown in FIG. 10(*b*). While the voltage Vd is higher than the reference voltage $V_{ref3}$, the operational amplifier 66 outputs the low level one-shot pulse Sp whose width is TC as shown in FIG. 10(*c*). The pulse width TC of the one-shot pulse is determined such that it is substantially equal to the operating time TM of the electromagnet.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A DC electromagnet apparatus comprising:

a power source for generating a power supply voltage;

a stator core on which an operation coil is wound;

a movable core facing the stator core via a gap;

a switching device connected in series with the operation coil;

a detecting resistor, connected in series with the operation coil and the switching device, for detecting a coil current flowing through the operation coil;

a voltage detecting circuit for detecting said power supply voltage, and generating a detection signal when the power supply voltage exceeds a predetermined reference voltage;

a one-shot pulse generating circuit for generating a one-shot pulse whose pulse width corresponds to a duration of a making coil current flowing through the operation coil;

a Miller circuit receiving the one-shot pulse outputted from the one-shot pulse generating circuit, and producing a trapezoidal pulse having a predetermined rising rate, a predetermined peak value, and a pulse width substantially equal to that of the one-shot pulse;

a voltage divider dividing the detection signal outputted from the voltage detecting circuit at a predetermined ratio;

an integrator integrating a voltage across the detecting resistor for detecting the coil current flowing through the operation coil; and a comparator having a first input terminal supplied with the higher of the output of the voltage divider and the peak value of the trapezoidal pulse outputted from the Miller circuit, and whose second input terminal is supplied with the output of the integrator, the comparator supplying an ON control signal to a control terminal of the switching device when the voltage applied to the first input terminal is higher than that applied to the second input terminal.

2. The DC electromagnet apparatus as claimed in claim 1, further comprising a constant voltage circuit producing a constant voltage, wherein the voltage detecting circuit comprises a first voltage divider dividing the power supply voltage, a second voltage divider dividing the constant voltage to produce a first reference voltage, and an operational amplifier whose noninverting input terminal is supplied with the divided voltage produced by the first voltage divider, and whose inverting input terminal is supplied with the first reference voltage, the operational amplifier outputting the detection signal when the voltage supplied to the noninverting input terminal is higher than the first reference voltage.

3. The DC electromagnet apparatus as claimed in claim 1, further comprising a constant voltage circuit producing a constant voltage, wherein the one-shot pulse generating circuit comprises:

a charging circuit including a capacitor to which the detection signal outputted from the voltage detection circuit is supplied, and a resistor connected in series with the capacitor;

a third voltage divider dividing the constant voltage to generate a third reference value;

an operational amplifier whose noninverting input terminal is supplied with the third reference voltage, and whose inverting input terminal is supplied with a voltage across the resistor of the charging circuit, the operational amplifier outputting the one-shot pulse when the voltage supplied to the inverting input terminal is higher than the third reference voltage.

4. The DC electromagnet apparatus as claimed in claim 1, wherein the Miller circuit comprises:

an operational amplifier whose noninverting input terminal is supplied with a second reference voltage, and whose inverting input terminal is supplied with the one-shot pulse outputted from the one-shot pulse generating circuit, the operational amplifier producing an output of the Miller circuit when the one-shot pulse is lower than the second reference voltage; and a charge-discharge circuit connected between an output terminal of the operational amplifier and a output terminal of the one-shot pulse generating circuit.

5. The DC electromagnet apparatus as claimed in claim 1, wherein the rising rate of the trapezoidal pulse outputted from the Miller circuit is set lower than a rising rate of the voltage across the detecting resistor detecting the coil current flowing through the operation coil when the power supply voltage changes in a working voltage range.

* * * * *